US005872427A

United States Patent [19]

Kroes

[11] Patent Number: 5,872,427

[45] Date of Patent: Feb. 16, 1999

[54] GLOWSWITCH STARTER WITH SPECIFIC GLASS ENVELOPE COMPOSITION

[75] Inventor: Anthony Kroes, Terneuzen, Netherlands

[73] Assignee: U.S. Philips corporation, New York, N.Y.

[21] Appl. No.: 915,801

[22] Filed: Aug. 21, 1997

[30] Foreign Application Priority Data

Aug. 30, 1996 [EP] European Pat. Off. ..... 96202417

[51] Int. Cl.[6] ..... H01J 17/16

[52] U.S. Cl. ..... 313/636; 313/634

[58] Field of Search ..... 313/146, 147, 313/151, 231.41, 573, 619, 634, 636

[56] References Cited

U.S. PATENT DOCUMENTS 3,849,190 11/1974 Foster et al. ..... 313/587

FOREIGN PATENT DOCUMENTS

0634884A1 1/1995 European Pat. Off. ..... H05B 41/08

*Primary Examiner*—Vip Patel

*Attorney, Agent, or Firm*—Walter M. Egbert, III

[57] ABSTRACT

A glowswitch starter according to the invention is provided with a discharge vessel (1) which is closed in a gastight manner and which has a wall (2), with a pair of electrical conductors (3*a*, 3*b*) passed through a portion (2*b*) of the wall of the discharge vessel, and with a bimetal element (4*a*) in the discharge vessel which is conductively connected to one (3*a*) of the electrical conductors (3*a*, 3*b*), the discharge vessel containing an ionizable filling. The glowswitch starter according to the invention, which is characterized in that at least that portion (2*b*) of the wall through which the electrical conductors are passed is made from a glass containing at least 5% BaO by weight, has a short ignition delay time.

3 Claims, 1 Drawing Sheet

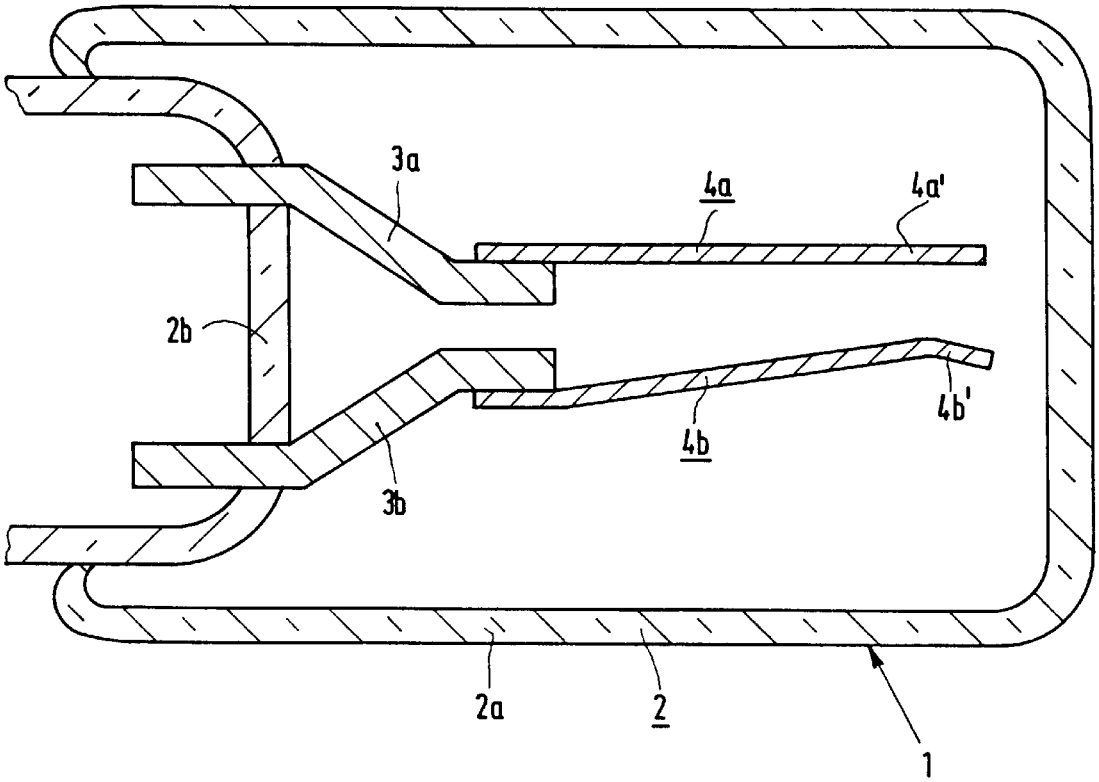
3a
4a
4a'
2b
4b'
4b
3b
2a
2
1

GLOWSWITCH STARTER WITH SPECIFIC GLASS ENVELOPE COMPOSITION

BACKGROUND OF THE INVENTION

The invention relates to a glowswitch starter provided with a discharge vessel which is closed in a gastight manner and which has a wall, with a pair of electrical conductors passed through a portion of the wall of the discharge vessel, and with a bimetal element in the discharge vessel which is conductively connected to one of the electrical conductors, the discharge vessel having an ionizable filling.

Such a glowswitch starter is known from EP 634 884. Such a glowswitch starter may be used, for example, in a device for operating a discharge lamp with preheatable electrodes, in which case the glowswitch starter shunts the discharge lamp and is connected in series with the electrodes. The operation of such a glowswitch starter in such a device is as follows. A glow discharge will be generated between the electrical conductors of the glowswitch starter under the influence of a voltage present across the discharge lamp, after an ignition delay time. This glow discharge heats the bimetal element connected to one of the electrical conductors, which causes said bimetal element to deform such that it makes contact with the other electrical conductor. The creation of this contact extinguishes the glow discharge, and a current will flow through the electrodes of the discharge lamp through the electrical conductors and the bimetal element of the glowswitch starter. This current brings the electrodes of the discharge lamp to a temperature at which an emission of electrons takes place to a degree sufficient for the discharge lamp to ignite. The bimetal element of the glowswitch starter cools down during heating of the electrodes of the discharge lamp and is deformed such that the contact between the two electrical conductors of the glowswitch starter is broken. The interruption of the contact also interrupts the current through the lamp electrodes, and an inductive element connected in series with the lamp generates an ignition voltage pulse. If a discharge between the electrodes of the discharge lamp is initiated by this ignition voltage pulse, the voltage across the discharge lamp, and accordingly the voltage between the electrical conductors of the glowswitch starter, is reduced to the point where no further glow discharge takes place. If no discharge is initiated between the electrodes of the discharge lamp by the ignition voltage pulse, however, the process described above will repeat itself. It is desirable for the ignition delay time which elapses between the moment at which a voltage is offered to the electrical conductors of the glowswitch starter and the moment at which a glow discharge arises to be short, i.e. shorter than 1 s. A hydrogen getter is present for this purpose in the discharge vessel of the known glowswitch starter, which getter comprises an alloy of palladium and zirconium. It is a disadvantage, however, that this requires additional operations for inter alia dosing and applying the getter. Radioactive elements are also used, for example $^{85}Kr$, as an ingredient of the ionizable filling, or $Ti^3H_x$ on the discharge vessel wall. This measure also involves additional operations, especially because radioactive elements are to be handled with great care for reasons of safety.

SUMMARY OF THE INVENTION

It is an object of the invention to provide a glowswitch starter which has a short ignition delay time without additional measures being necessary such as the application of a hydrogen getter or the use of radioactive elements. According to the invention, the glowswitch starter is for this purpose characterized in that at least that portion of the wall through which the electrical conductors are passed is made from a glass which comprises at least 5% BaO by weight. It was found by the inventor in experiments that the glowswitch starter according to the invention has a short ignition delay time also without the above-mentioned additional measures. It was also found in these experiments that the material from which the remaining portion of the discharge vessel wall is made is of no importance. A possible explanation for the short ignition delay time of the glowswitch starter according to the invention is that BaO in the glass of said portion of the wall is active as an emitter.

A favorable embodiment of the glowswitch starter according to the invention is characterized in that the glass comprises at least the ingredients mentioned in Table 1 in percentages by weight which lie within the limits listed in said Table:

TABLE 1

| $SiO_2$ | $Al_2O_3$ | $Li_2O$ | $Na_2O$ | $K_2O$ | MgO | CaO | SrO | BaO |
|---|---|---|---|---|---|---|---|---|
| 60–72 | 1–5 | 0.5–1.5 | 5–9 | 3–7 | 1–2 | 1–3 | 1–5 | 7–11. |

Glass having this composition is easy to process because it has a low crystallization temperature and a long softening range. The glass may be purified with $Na_2SO_4$, so that it may comprise up to 0.1% $SO_3$ by weight in addition. The glass may also comprise a small percentage by weight of impurities originating from basic materials from which the glass was made. For example, up to 0.02% $Fe_2O_3$ may be present in the glass. The glass may in addition comprise, for example, a small proportion, for example 0.01 to 1.0% by weight, of CeO.

To obtain a low ignition voltage, the ionizable filling in the glowswitch starter according to the invention preferably is a Penning mixture such as Ne—Xe or Ne—Ar, for example in a volume ratio of between 90:10 and 99:1.

BRIEF DESCRIPTION OF THE DRAWINGS

The above and further aspects will be explained in more detail with reference to the drawing, in which the sole FIGURE shows an embodiment of the glowswitch starter according to the invention.

DESCRIPTION OF THE PREFERRED EMBODIMENTS

The Figure shows a discharge vessel 1 which is closed in a gastight manner and which has a wall 2. The discharge vessel 1 is provided with an ionizable filling, a Penning mixture in the embodiment shown with a composition of 90% Ne and 10% Ar by volume. The filling pressure at room temperature is 26.6 mbar. The wall 2 of the discharge vessel has an enveloping portion 2*a* and a recessed portion 2*b*. A pair of electrical conductors 3*a*, 3*b* is passed through the recessed portion 2*b*. The electrical conductors 3*a*, 3*b* are formed by a core of an Ni—Fe alloy and a sheath of Cu. 4*a* denotes a bimetal element in the discharge vessel 1 which is conductively connected to one (3*a*) of the electrical conductors. A further element 4*b*, here also a bimetal element, is connected to the electrical conductor 3*b*. The further bimetal element 4*b* has a free end portion 4*b*' which is bent into a V-shape which points towards the bimetal element 4*a*. The bimetal element 4*a* here has a straight free end portion 4*a*'. Alternatively, for example, it may have an end portion whose shape corresponds to that of the end portion 4*b*' and which is positioned so as to be the mirrored image of the end portion 4b' of the further bimetal element 4b. The bimetal elements 4a, 4b comprise an active side formed from an alloy of $Ni_{20}Fe_{74}Mn_6$ (% by weight), and a passive side formed from an alloy of $Ni_{36}Fe_{64}$ (% by weight). In an alternative embodiment, for example, the active side may be formed from the alloy $Ni_{10}Cu_{18}Mn_{72}$. Both sides of the bimetal elements are coated with an electrochemically provided emitter layer of Zn.

In an embodiment, the bimetal element is a body bent into a U-shape which is connected with a first leg to its electrical conductor, while the second leg is bent away from the first when the bimetal element is in the heated state so as to make contact with the other electrical conductor via the further element. The further element may in that case be integral with the latter electrical conductor.

At least that portion 2b of the wall 2 of the discharge vessel 1 through which the electrical conductors are passed, here the recessed portion 2b, is made from a glass which comprises at least 5% BaO by weight, in the embodiment shown a glass having the composition as indicated with A in Table 2. The discharge vessel is entirely made from this glass in the present case. Glass of this composition comprises the ingredients $SiO_2$, $Al_2)_3$, $Li_2O$, $Na_2O$, $K_2O$, MgO, CaO, SrO, and BaO in percentages by weight which lie within the limits listed in Table 1.

TABLE 2

| | $SiO_2$ | $B_2O_3$ | $Al_2O_3$ | $Li_2O$ | $Na_2O$ | $K_2O$ | MgO | CaO | SrO | BaO | PbO |
|---|---|---|---|---|---|---|---|---|---|---|---|
| A | 68.2 | — | 3.4 | 1.2 | 7.4 | 5.0 | 1.3 | 1.9 | 2.9 | 8.7 | — |
| B | 65.0 | — | 1.3 | — | 6.7 | 7.0 | — | — | — | — | 20.0 |
| C | 72.8 | — | 1.6 | — | 16.8 | 0.9 | 2.6 | 5.3 | — | — | — |

Table 2 also lists compositions of further glasses B and C in addition to glass A.

A series of 10 glowswitch starters according to the invention of the kind described with reference to the Figure were manufactured, referred to as inv1 hereinafter. Three other series, inv2, inv3 and inv4, of 10 glowswitch starters each were also manufactured. The filling pressure of the ionizable filling is 29.3 instead of 26.6 mbar in series inv2. The glasses referred to as B and C in Table 2 were used for the series inv3 and inv4, respectively, as far as their enveloping portions were concerned. The recessed portions were made of glass A, as were those of the glowswitch starters in series inv1. The series inv2, inv3, and inv4 correspond to the series invl also in respects other than those mentioned.

Four series of glowswitch starters not according to the invention were manufactured for comparison. These series, referred to as ref1, ref2, ref3, and ref4, also comprise 10 starters each. The glass of the recessed portion is here made of type B, which comprises less than 5% BaO by weight. The enveloping portion in series refl is made of type A glass. The discharge vessel is entirely made of type B glass in the series ref2, ref3, and ref4. The glowswitch starters of series ref3 and ref4 have filling pressures of 29.3 and 31.9 mbar, respectively. The glowswitch starters of series ref1, ref2, ref3, and ref4 are identical to those of series inv1 in all other respects.

Ignition properties of the above eight series of glowswitch starters are given in Table 3. These ignition properties are the average ignition delay time ($t_{av}$), the maximum ignition delay time ($t_{max}$) and the percentage ($\%_{>1s}$) of cases in which the ignition delay time exceeds 1 s. The ignition delay time was measured three times for each glowswitch starter. Said ignition properties were measured after the glowswitch starters had been switched on and off 2000 times. In addition to said ignition properties, the Table lists the glass type (Glass-1) of the wall portion through which the electrical conductors are passed and the glass type (Glass-2) from which the remaining portion of the discharge vessel wall was manufactured. The filling pressure (P) of the ionizable filling in the discharge vessel is also indicated.

TABLE 3

| | Glass-1 | Glass-2 | P(mbar) | $t_{av}$ (s) | $t_{max}$ (s) | $\%_{>1s}$ |
|---|---|---|---|---|---|---|
| inv1 | A | A | 26.6 | 0.10 | 0.22 | 0 |
| inv2 | A | A | 29.3 | 0.10 | 0.10 | 0 |
| inv3 | A | B | 26.6 | 0.11 | 0.26 | 0 |
| inv4 | A | C | 26.6 | 0.10 | 0.16 | 0 |
| ref1 | B | A | 26.6 | 1.26 | 4.65 | 43 |
| ref2 | B | B | 26.6 | 0.19 | 1.27 | 3 |
| ref3 | B | B | 29.3 | 0.40 | 4.66 | 7 |
| ref4 | B | B | 31.9 | 1.47 | 10.0 | 17 |

It is apparent from the Table that the average ignition delay time ($t_{av}$) and the maximum ignition delay time ($t_{max}$) are much shorter in the glowswitch starters according to the invention (inv1–inv4) than in the glowswitch starters not according to the invention (ref1–ref4). The ignition delay time is shorter than 1 s in all cases in the glowswitch starters according to the invention. The choice of the glass type for the enveloping portion of the discharge vessel was found to be immaterial to the ignition properties of the glowswitch starter.

I claim:

1. A glowswitch starter comprising a discharge vessel (1) which is closed in a gastight manner and which has a wall (2), with a pair of electrical conductors (3a, 3b) passed through a portion (2b) of the wall of the discharge vessel, and with a bimetal element (4a) in the discharge vessel which is conductively connected to one (3a) of the electrical conductors (3a, 3b), the discharge vessel having an ionizable filling, wherein at least that portion (2b) of the wall through which the electrical conductors are passed is made from a glass which comprises at least 5% BaO by weight.

2. A glowswitch starter as claimed in claim 1, characterized in that the glass comprises at least the ingredients mentioned in the Table below in percentages by weight which lie within the limits listed in this Table:

| $SiO_2$ | $Al_2O_3$ | $Li_2O$ | $Na_2O$ | $K_2O$ | MgO | CaO | SrO | BaO |
|---|---|---|---|---|---|---|---|---|
| 60–72 | 1–5 | 0.5–1.5 | 5–9 | 3–7 | 1–2 | 1–3 | 1–5 | 7–11. |

3. A glowswitch starter as claimed in claim 2, wherein the ionizable filling is a Penning mixture.

* * * * *